US009809980B2

(12) United States Patent
Bredeweg

(10) Patent No.: US 9,809,980 B2
(45) Date of Patent: Nov. 7, 2017

(54) RAKE EDGE

(71) Applicant: Quality Edge, Inc., Walker, MI (US)

(72) Inventor: Mark Allen Bredeweg, Zeeland, MI (US)

(73) Assignee: Quality Edge, Inc., Walker, MI (US)

( * ) Notice: Subject to any disclaimer, the term of this patent is extended or adjusted under 35 U.S.C. 154(b) by 0 days.

(21) Appl. No.: 15/277,653

(22) Filed: Sep. 27, 2016

(65) Prior Publication Data

US 2017/0089074 A1 Mar. 30, 2017

Related U.S. Application Data

(60) Provisional application No. 62/235,235, filed on Sep. 30, 2015.

(51) Int. Cl.

| | |
|---|---|
| ***E04D 13/00*** | (2006.01) |
| ***E04D 13/158*** | (2006.01) |
| ***E04D 13/04*** | (2006.01) |
| ***E04D 1/26*** | (2006.01) |

(52) U.S. Cl.

CPC ..... *E04D 13/158* (2013.01); *E04D 1/265* (2013.01); *E04D 13/04* (2013.01); *E04D 13/0459* (2013.01); *E04D 2013/0468* (2013.01); *E04D 2013/0486* (2013.01)

(58) Field of Classification Search

CPC ..... E04D 13/158; E04D 2013/0468; E04D 2013/0486; E04D 2013/0481; E04D 13/0459; E04D 13/04

USPC ..... 52/58, 96, 97

See application file for complete search history.

(56) References Cited

U.S. PATENT DOCUMENTS

| | | | | |
|---|---|---|---|---|
| 3,242,622 | A * | 3/1966 | Snead | E04D 13/15 52/364 |
| 4,254,594 | A | 3/1981 | Hammond et al. | |
| 4,594,820 | A * | 6/1986 | Render | E04D 13/15 52/60 |
| 4,601,135 | A * | 7/1986 | Ellis | E04D 1/30 52/529 |
| 4,741,132 | A | 5/1988 | Emblin | |
| 4,964,248 | A * | 10/1990 | Braine | E04D 3/405 52/300 |
| 5,170,597 | A | 12/1992 | Stearns | |
| 6,035,587 | A | 3/2000 | Dressler | |
| 6,237,293 | B1 * | 5/2001 | Gembala | E04D 13/0431 52/302.6 |

(Continued)

FOREIGN PATENT DOCUMENTS

| | | | | |
|---|---|---|---|---|
| DE | 10124050 | A1 * | 11/2002 | E04D 13/158 |
| GB | 2498138 | A * | 7/2013 | E04D 13/155 |

*Primary Examiner* — Adriana Figueroa

(74) *Attorney, Agent, or Firm* — Price Heneveld LLP

(57) ABSTRACT

A rake edge for a roof of a building includes a body having a lower portion and an upper portion. A fold is disposed on an inside end of the body. A downwardly extending side shield protrudes orthogonally from the lower portion. A shield edge protrudes outwardly from the side shield at an angle between 5 degrees and 90 degrees from a planar extent of the side shield. A shield edge underlap projects inwardly parallel with the shield edge. A trim portion extends over the upper portion. The trim portion is generally parallel with the upper portion and spaced a predetermined distance therefrom. A trim portion underlap is disposed between the upper portion and the trim portion.

20 Claims, 7 Drawing Sheets

(56) References Cited

U.S. PATENT DOCUMENTS

| | | | | |
|---|---|---|---|---|
| 6,449,910 | B1 | 9/2002 | Budd | |
| 6,912,813 | B2 * | 7/2005 | Grizenko | E04D 3/40 49/471 |
| D569,011 | S | 5/2008 | Brochu | |
| 8,205,397 | B2 * | 6/2012 | Nark | E04D 13/103 52/58 |
| 8,281,521 | B1 | 10/2012 | Rasmussen et al. | |
| 8,739,470 | B1 * | 6/2014 | Wayne | E04D 13/15 52/58 |
| 2003/0177708 | A1 * | 9/2003 | Gatherum | E02D 31/02 52/58 |
| 2008/0196231 | A1 | 8/2008 | Grove | |

* cited by examiner

RAKE EDGE

CROSS-REFERENCE TO RELATED APPLICATION

This application claims priority to and the benefit under 37 U.S.C. §119(e) of U.S. Provisional Application No. 62/235,235, filed on Sep. 30, 2015, entitled "RAKE EDGE," the disclosure of which is hereby incorporated herein by reference in its entirety.

BACKGROUND OF THE DISCLOSURE

The present disclosure generally relates to a rake edge for a roof of a building, and more particularly to a rake edge for use with a metal roof of a building.

SUMMARY OF THE DISCLOSURE

One aspect of the present disclosure includes a rake edge for a roof of a building. A body includes a lower portion and an upper portion. A fold is disposed on an inside end of the body. A downwardly extending side shield protrudes orthogonally from the lower portion. A shield edge protrudes outwardly from the side shield at an angle between 5 degrees and 90 degrees from a planar extent of the side shield. A shield edge underlap projects inwardly parallel with the shield edge. A trim portion extends over the upper portion. The trim portion is generally parallel with the upper portion and spaced a predetermined distance therefrom. A trim portion underlap is disposed between the upper portion and the trim portion.

Another aspect of the present disclosure includes a rake edge for a roof of a building. A body includes a lower portion and an upper portion. A fold is disposed on an inside end of the body. A downwardly extending side shield protrudes orthogonally from the lower portion. A shield edge protrudes outwardly from the side shield at an angle between 5 degrees and 90 degrees from a planar extent of the side shield. The shield edge includes a distal end. A trim portion extends over the upper portion. The trim portion is generally parallel with the upper portion and spaced a predetermined distance therefrom. The trim portion and the upper portion define a rounded outside edge. The lateral distance from the inside end of the body to the rounded outside edge is greater than the lateral distance from the inside end of the body to the distal end of the shield edge.

Still another aspect of the present disclosure includes a rake edge for a roof of a building. A body includes a lower portion and an upper portion. A fold is disposed on an inside end of the body. A downwardly extending side shield protrudes orthogonally from the lower portion. A shield edge protrudes outwardly from the side shield at an angle between 5 degrees and 90 degrees from a planar extent of the side shield. A trim portion extends over the upper portion. The trim portion is generally parallel with the upper portion and spaced a predetermined distance therefrom.

These and other features, advantages, and objects of the present disclosure will be further understood and appreciated by those skilled in the art by reference to the following specification, claims, and appended drawings.

DETAILED DESCRIPTION

Figure 1:
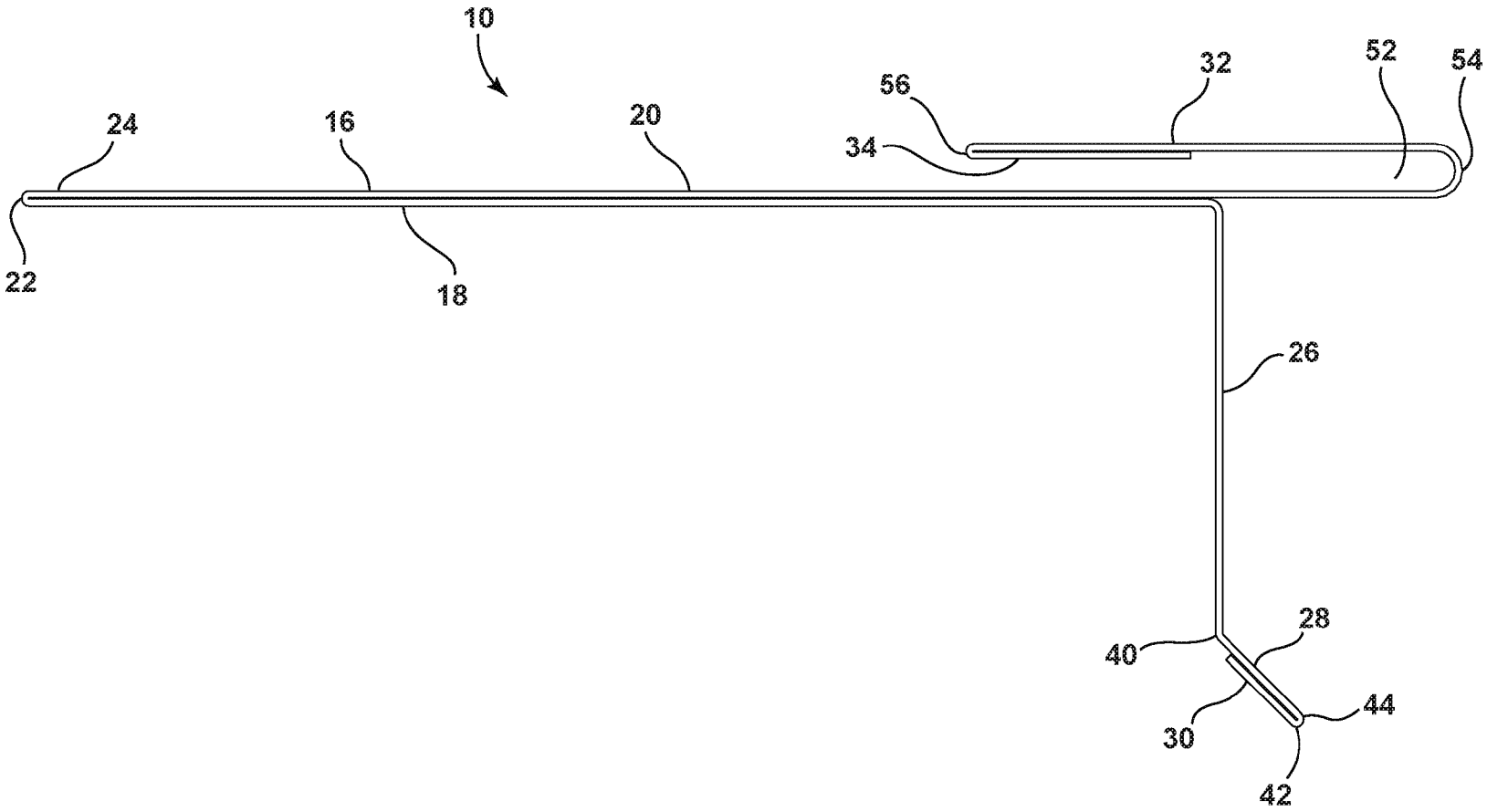
FIG. 1 is a front elevational view of one embodiment of a rake edge for use with a metal roof.

For purposes of description herein, the terms "upper," "lower," "right," "left," "rear," "front," "vertical," "horizontal," and derivatives thereof shall relate to the disclosure as oriented in FIG. 1. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

In this document, relational terms, such as first and second, top and bottom, and the like, are used solely to distinguish one entity or action from another entity or action, without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises . . . a" does not, without more constraints, preclude the existence of additional identical elements in the process, method, article, or apparatus that comprises the element.

As used herein, the term "and/or," when used in a list of two or more items, means that any one of the listed items can be employed by itself, or any combination of two or more of the listed items can be employed. For example, if a composition is described as containing components A, B, and/or C, the composition can contain A alone; B alone; C alone; A and B in combination; A and C in combination; B and C in combination; or A, B, and C in combination.

Referring now to FIGS. 1-7, reference numeral 10 generally designates a rake edge for a roof 12 of a building 14. A body 16 includes a lower portion 18 and an upper portion 20. A fold 22 is disposed on an inside end 24 of the body 16. A downwardly extending side shield 26 protrudes orthogonally from the lower portion 18. A shield edge 28 protrudes outwardly from the side shield 26 at an angle between 5 degrees and 90 degrees from a planar extent of the side shield 26. A shield edge underlap 30 projects inwardly parallel with the shield edge 28. A trim portion 32 extends over the upper portion 20. The trim portion 32 is generally parallel with the upper portion 20 and spaced a predetermined distance therefrom. A trim portion underlap 34 is disposed between the upper portion 20 and the trim portion 32.

The body 16 of the rake edge 10 is generally planar in configuration, and in the illustrated embodiment, the upper portion 20 and the lower portion 18 are in abutting contact. The downwardly extending side shield 26, as illustrated, extends orthogonally downward from the lower portion 18 of the body 16. The downwardly extending side shield 26 is generally configured to extend downwardly a distance to adequately cover the edge of the roof 12 to provide an aesthetically pleasing appearance to the same. The shield edge 28 protrudes from a distal end 40 of the side shield 26, and in the illustrated embodiment, projects at approximately a 45 degree angle relative to the planar extent of the side shield 26. However, it is contemplated that the shield edge 28 may be coplanar with the downwardly extending side shield 26, or extend up to a 90 degree angle from the planar extent of the side shield 26. The shield edge underlap 30 of the shield edge 28 extends inwardly and upwardly along with the shield edge 28. The shield edge 28 and the shield edge underlap 30 are connected by a fold 42 at a distal end 44 of the shield edge 28. In addition, the shield edge underlap 30 may be as long as the shield edge 28, or may be any length less than the shield edge 28.

With reference again to FIG. 1, the trim portion 32 is spaced a predetermined distance above the upper portion 20 of the body 16. It is generally configured that the distance that the trim portion 32 is spaced from the upper portion 20 will be sufficient to receive an edge 46, likely a cut edge, of a roofing panel 50. The trim portion 32, as well as the side shield 26 and shield edge 28, may include a protective coating that is generally weather resistant. The trim portion 32 and the upper portion 20 of the rake edge 10 generally define a receiving cavity 52 therebetween that is configured to receive the edge 46 of the roofing panel 50. A method of installation of the rake edge 10 and the roofing panel 50 is disclosed in further detail below. The trim portion underlap 34 of the trim portion 32 protrudes outwardly toward a rounded outside edge 54 of the trim portion 32. As illustrated, the fold 22 includes a diameter that is less than a diameter of the rounded outside edge 54. A lateral distance from the side shield 26 to the rounded outside edge 54 is less than a lateral distance from a terminal end of the trim portion underlap 34 to the rounded outside edge 54. The trim portion underlap 34 may extend any distance that is equal to or less than the width of the trim portion 32. In the illustrated embodiment, the trim portion underlap 34 is less than half the width of the trim portion 32. Notably, the trim portion underlap 34 and the trim portion 32 are connected by a fold 56 disposed at an inside edge thereof.

Figure 2:
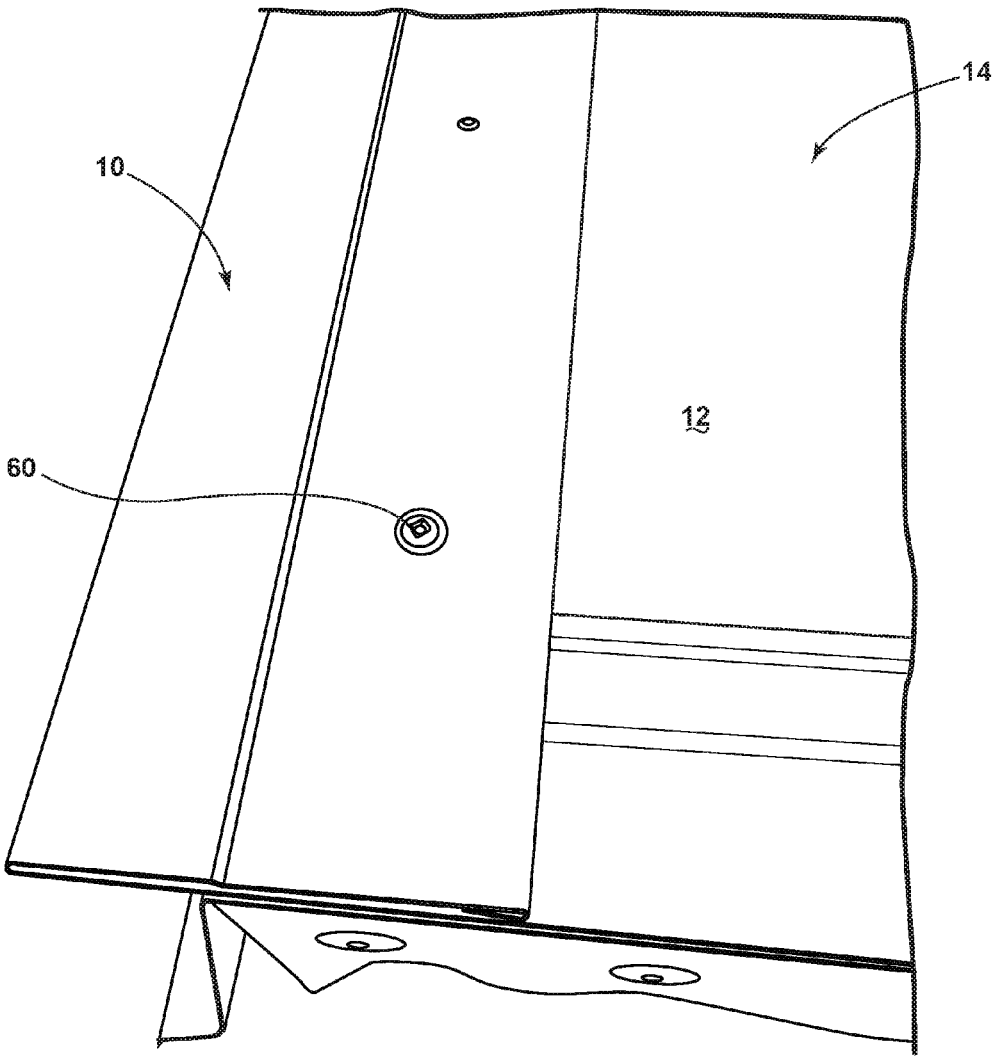
FIG. 2 is a top perspective view of a rake edge of the present disclosure coupled with a roof edge.
Figure 3:
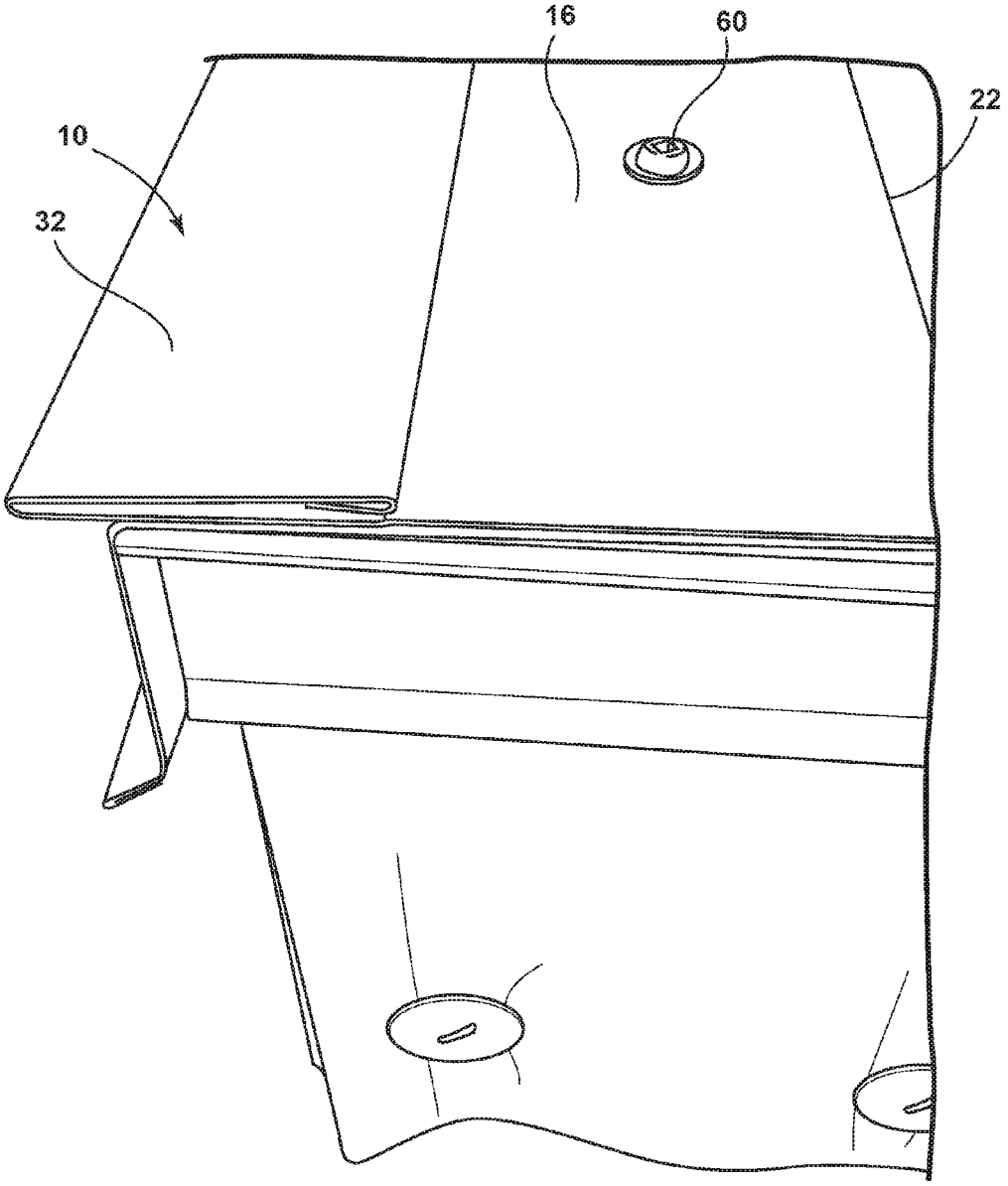
FIG. 3 is a front perspective view of a rake edge installed on the edge of a roof.

With reference now to FIGS. 2 and 3, the rake edge 10 is generally configured to be coupled to the roof 12 via mechanical fasteners. The mechanical fasteners secure the rake edge 10 to the roof 12 prior to installation of the last roofing panel in a run. As can be clearly seen in the illustrated figures, the receiving cavity 52 defined between the trim portion 32 and the upper portion 20 of the body 16 is configured to receive the cut edge 46 of the roofing panel 50. Once received in the receiving cavity 52, the cut edge 46 of the roofing panel 50 is no longer visible, thereby providing an aesthetically pleasing appearance to a user.

Figure 4:
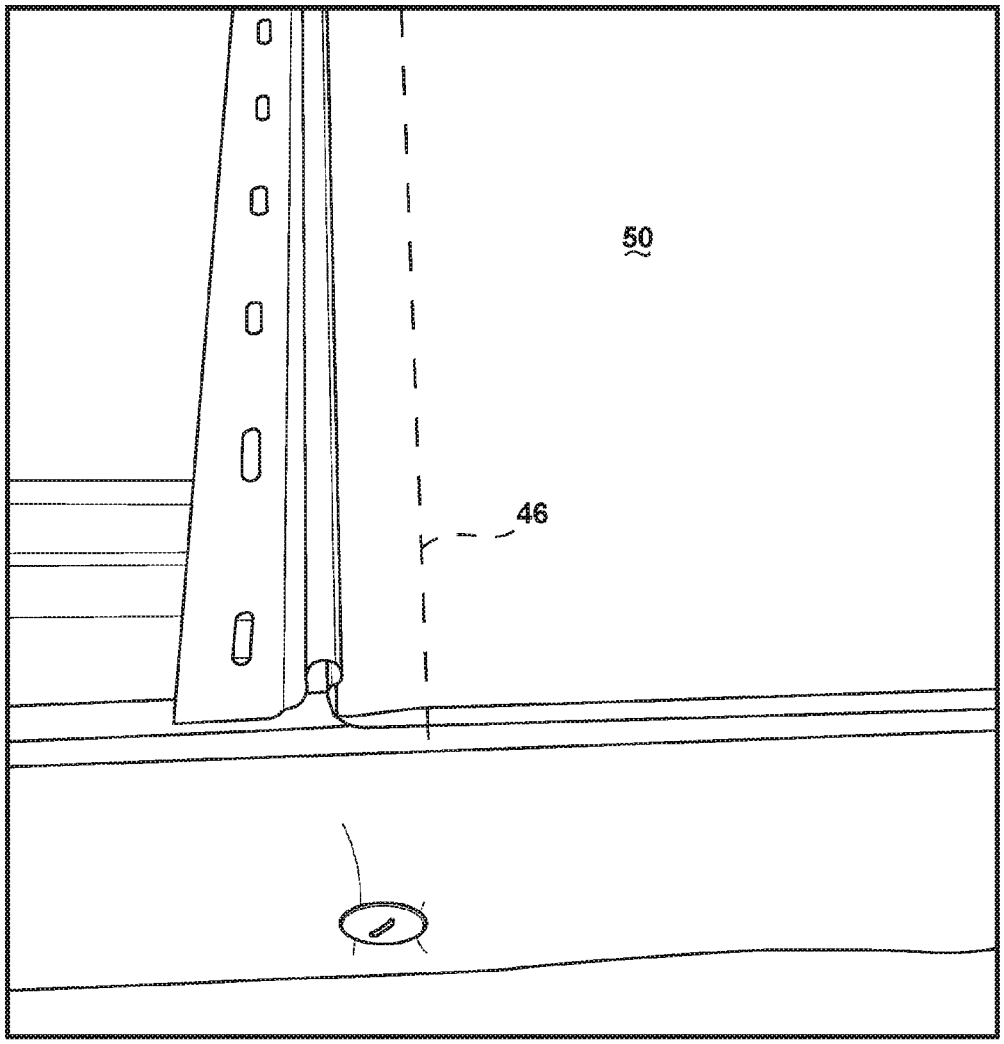
FIG. 4 is a top perspective view of a metal roof panel configured for use with at least one embodiment of a rake edge as set forth herein.

FIG. 4 generally illustrates one embodiment of the roofing panel 50 configured for use with the rake edge 10 as set forth herein. Notably, the cut edge 46 of the roofing panel 50 will be cut via tin snips, for example, prior to insertion into the receiving cavity 52 defined between the upper portion 20 and the trim portion 32 of the rake edge 10.

Figure 5:
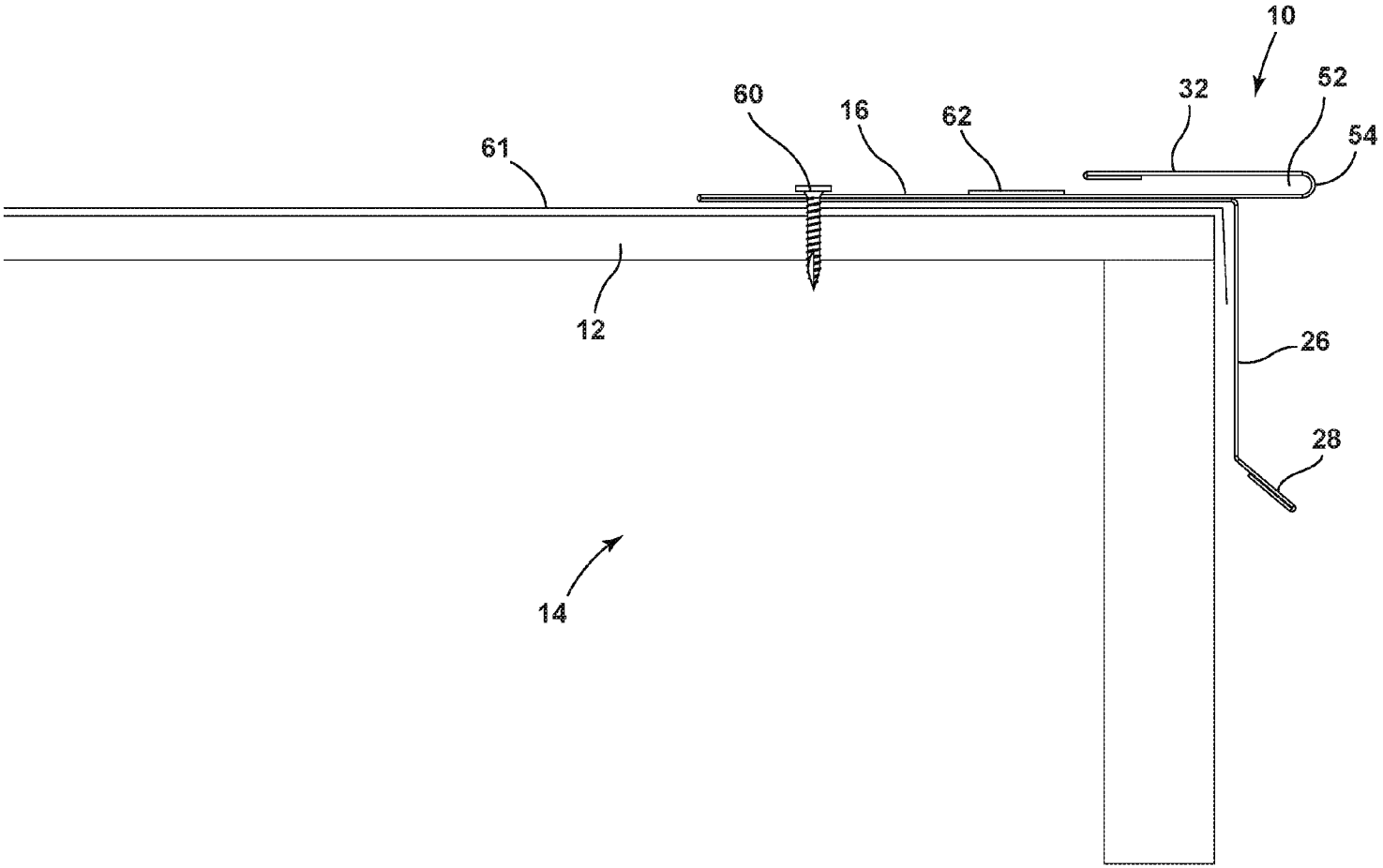
FIG. 5 is a front elevational view of one embodiment of a rake edge installed on a roof edge.
Figure 6:
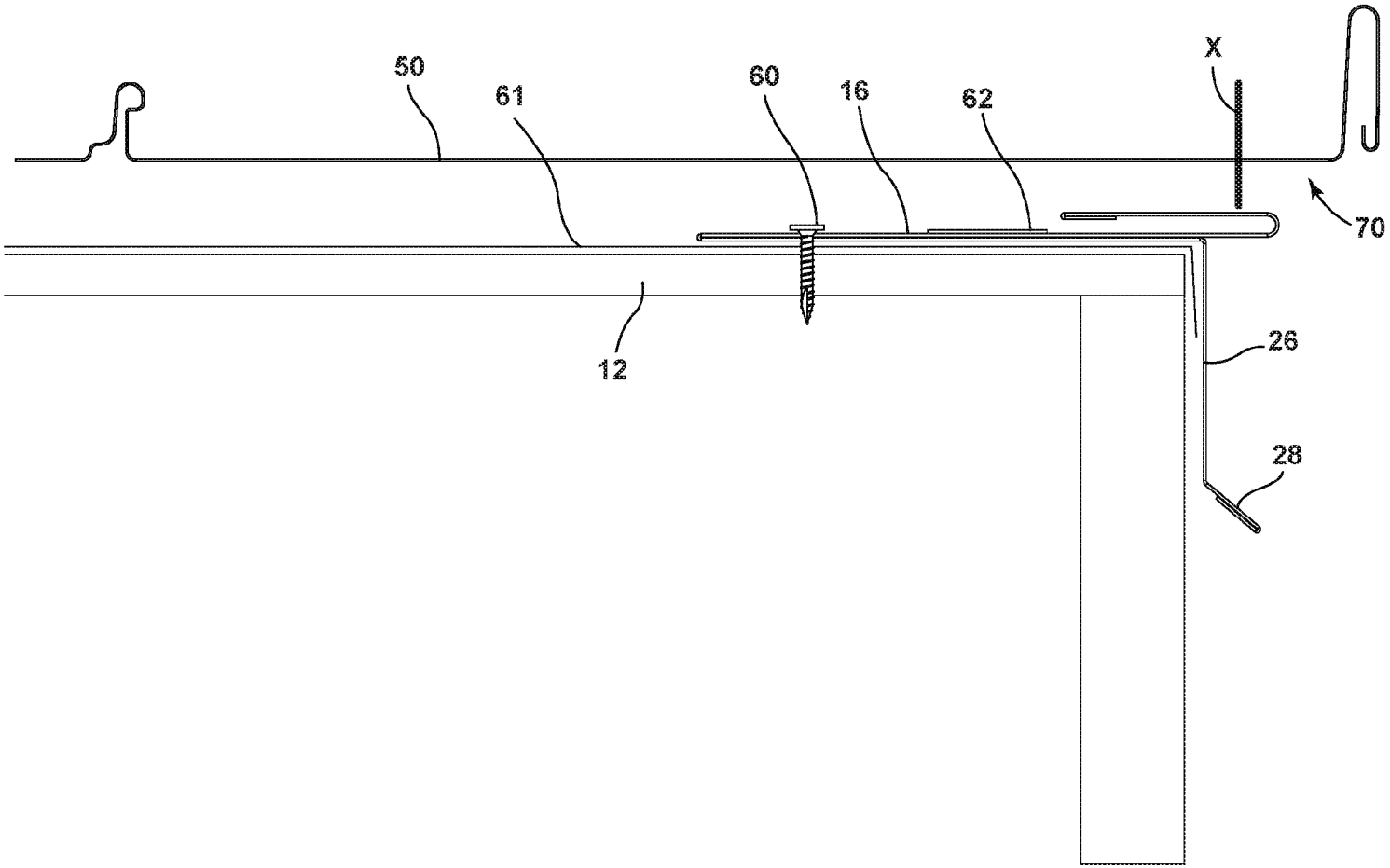
FIG. 6 is a front elevational view of the rake edge of FIG. 5 prior to engagement with a roof panel.
Figure 7:
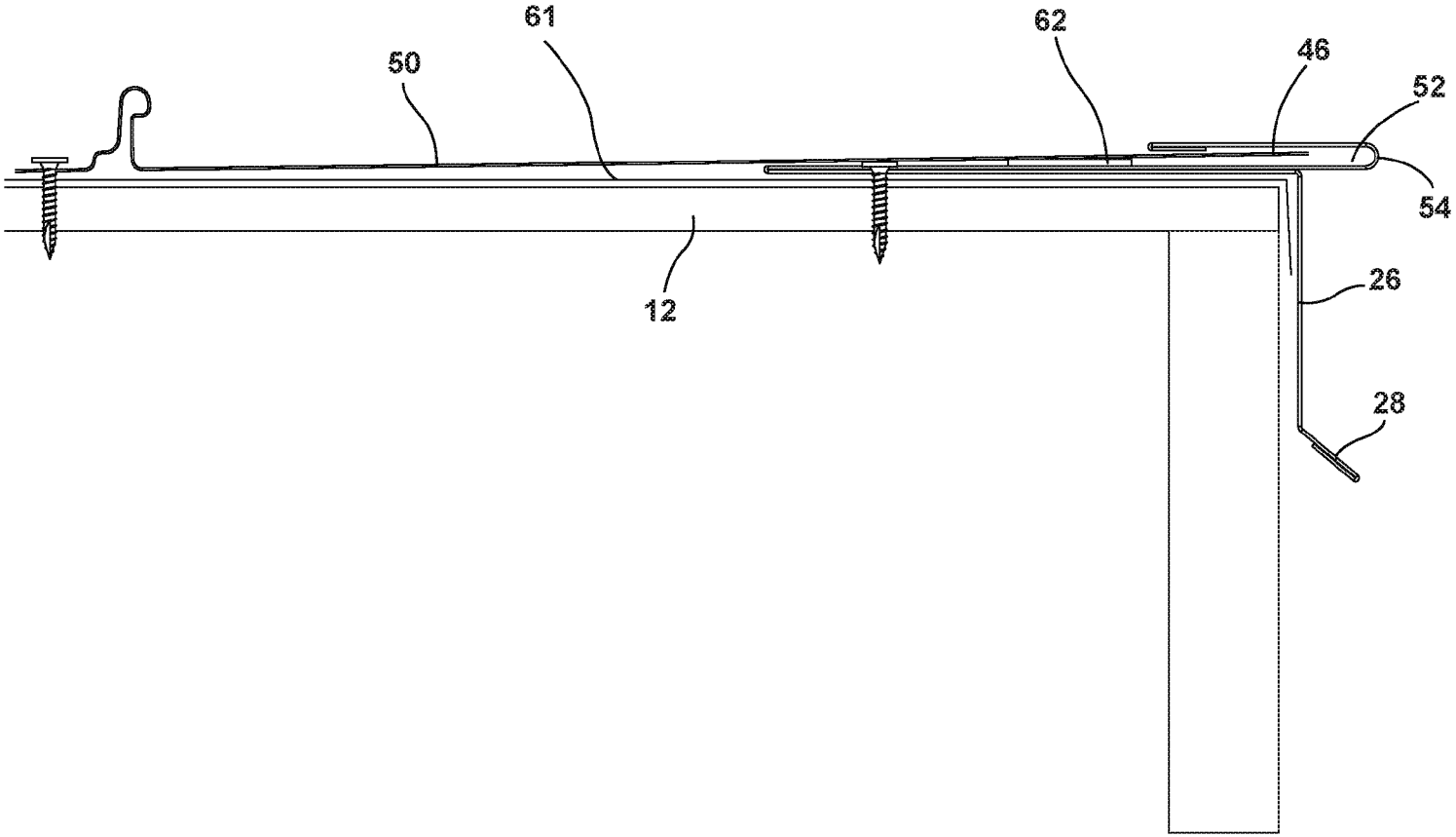
FIG. 7 is a front elevational view of a rake edge and roof panel of the present disclosure after engagement with a roof.

With reference now to FIGS. 5-7, one embodiment of the rake edge 10 is illustrated. The rake edge 10 is secured to the edge of the roof 12 via a mechanical fastener 60. A roof cover material 61 is positioned on the roof 12 between the roof 12 and the rake edge 10. A strip of butyl tape 62 extends downwardly along the longitudinal length of the rake edge 10 and provides a water barrier that prohibits water from a space underneath the roofing panel 50 after installation. However, it is contemplated that any waterproof type sealant could be used between the rake edge 10 and the roofing panel 50.

With reference to FIG. 6, a roofing panel is illustrated prior to engagement with the rake edge 10. The roofing panel 50 is cut at cut line X. An outward portion 70 of the roofing panel 50 is discarded, and the cut edge 46 of the roofing panel 50 is prepared for insertion into the receiving cavity 52 of the rake edge 10.

With reference now to FIG. 7, the cut edge 46 of the roofing panel 50 is inserted into the receiving cavity 52 defined between the trim portion 32 and the upper portion 20 of the rake edge 10 in secure engagement with water barrier material 62, such as butyl tape, that is disposed on the upper portion 20 of the rake edge 10. As a result, a watertight fit is provided that minimizes or eliminates infiltration of water under the roofing panel 50. Accordingly, the likelihood of the roof 12 leaking is also minimized or eliminated. The resulting construction provides an aesthetically pleasing appearance to a user, and at the same time maintains a high degree of functionality and utility.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or numeral of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

It is also to be understood that variations and modifications can be made on the aforementioned structures and methods without departing from the concepts of the present disclosure, and further it is to be understood that such concepts are intended to be covered by the following claims unless these claims by their language expressly state otherwise.

What is claimed is:

1. A rake edge for a roof of a building comprising:

a body including a lower portion and an upper portion in direct contact with each other;

a fold disposed on an inside end of the body, the fold connecting the lower portion and the upper portion;

a downwardly extending side shield protruding orthogonally from the lower portion;

a shield edge protruding outwardly from the side shield at an angle between 5 degrees and 90 degrees from a planar extent of the side shield;

a shield edge underlap projecting inwardly parallel with the shield edge;

a trim portion extending over the upper portion, the trim portion being generally parallel with the upper portion and spaced a predetermined distance therefrom; and a trim portion underlap disposed between the upper portion and the trim portion.

2. The rake edge of claim 1, wherein the trim portion includes a protective coating.

3. The rake edge of claim 1, further comprising:

a rounded outside edge connecting the upper portion with the trim portion.

4. The rake edge of claim 3, wherein a lateral distance from the side shield to the rounded outside edge is less than a lateral distance from a terminal end of the trim portion underlap to the rounded outside edge.

5. The rake edge of claim 1, further comprising:

a mechanical fastener extending through the body.

6. The rake edge of claim 1, further comprising:

a roofing panel extending into a receiving cavity.

7. The rake edge of claim 1, further comprising:

a roof cover material adjacent the lower portion of the body.

8. A rake edge for a roof of a building comprising:

a body including a lower portion and an upper portion in direct contact with each other;

a fold disposed on an inside end of the body;

a downwardly extending side shield protruding orthogonally from the lower portion;

a shield edge protruding outwardly from the side shield at an angle between 5 degrees and 90 degrees from a planar extent of the side shield, the shield edge including a distal end; and a trim portion extending over the upper portion, the trim portion being generally parallel with the upper portion and spaced a predetermined distance therefrom, the trim portion and the upper portion defining a rounded outside edge, wherein a lateral distance from the inside end of the body to the rounded outside edge is greater than a lateral distance from the inside end of the body to the distal end of the shield edge.

9. The rake edge of claim 8, wherein the trim portion includes a protective coating.

10. The rake edge of claim 8, wherein a diameter of the rounded outside edge is greater than a diameter of the fold disposed on the inside end of the body.

11. The rake edge of claim 8, wherein a lateral distance from the side shield to the rounded outside edge is less than a lateral distance from a terminal end of an underlap to the rounded outside edge.

12. The rake edge of claim 8, further comprising:

a mechanical fastener extending through the body.

13. The rake edge of claim 8, further comprising:

a roofing panel extending into a receiving cavity.

14. The rake edge of claim 8, further comprising:

a roof cover material adjacent the lower portion of the body.

15. A rake edge for a roof of a building comprising:

a body including a lower portion and an upper portion in direct contact with each other;

a fold disposed on an inside end of the body, the fold connecting the lower portion and the upper portion;

a downwardly extending side shield protruding orthogonally from the lower portion;

a shield edge protruding outwardly from the side shield at an angle between 5 degrees and 90 degrees from a planar extent of the side shield; and a trim portion extending over the upper portion, the trim portion being generally parallel with the upper portion and spaced a predetermined distance therefrom.

16. The rake edge of claim 15, wherein the trim portion includes a protective coating.

17. The rake edge of claim 15, wherein a diameter of a rounded outside edge is greater than a diameter of the fold disposed on the inside end of the body.

18. The rake edge of claim 15, further comprising:

a rounded outside edge connecting the upper portion with the trim portion;

wherein a lateral distance from the side shield to the rounded outside edge is less than a lateral distance from a terminal end of an underlap to the rounded outside edge.

19. The rake edge of claim 15, further comprising:

a mechanical fastener extending through the body.

20. The rake edge of claim 15, further comprising:

a roofing panel extending into a receiving cavity.

* * * * *